US006365849B1

(12) United States Patent
Ono

(10) Patent No.: US 6,365,849 B1
(45) Date of Patent: Apr. 2, 2002

(54) COMPOSITE SWITCH

(75) Inventor: Koji Ono, Tsuyama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/520,952

(22) Filed: Mar. 8, 2000

(30) Foreign Application Priority Data

Mar. 9, 1999 (JP) ..... 11-061302

(51) Int. Cl.[7] ..... H01H 19/58
(52) U.S. Cl. ..... 200/14; 200/571; 200/18
(58) Field of Search ..... 200/411–18, 500–574, 200/414, 571, 538, 540, 541

(56) References Cited

U.S. PATENT DOCUMENTS

| | | | | | |
|---|---|---|---|---|---|
| 3,748,419 | A | * | 7/1973 | Torrey et al. | 200/155 R |
| 3,858,020 | A | * | 12/1974 | Brannon | 200/159 A |
| 3,892,931 | A | * | 7/1975 | Lockard | 200/11 R |
| 3,965,320 | A | * | 6/1976 | Ditzig | 200/314 |
| 4,166,200 | A | * | 8/1979 | Reichen et al. | 200/11 R |
| 4,855,541 | A | * | 8/1989 | Yamashita et al. | 200/6 R |
| 4,868,352 | A | | 9/1989 | Botz et al. | |
| 5,049,709 | A | * | 9/1991 | Prickett et al. | 200/527 |
| 5,847,345 | A | * | 12/1998 | Harrison | 200/284 |

FOREIGN PATENT DOCUMENTS

| | | |
|---|---|---|
| DE | 70 46 185 | 3/1972 |
| DE | 26 09 166 | 9/1977 |
| DE | 197 21 514 | 11/1997 |

* cited by examiner

*Primary Examiner*—P. Austin Bradley
*Assistant Examiner*—Nhung Nguyen
(74) *Attorney, Agent, or Firm*—Wenderoth, Lind & Ponack, L.L.P.

(57) ABSTRACT

A composite switch comprises a first fixed contact unit and a second fixed contact unit which are disposed on the surface of a substrate in such a manner as to be symmetrical about a reference line which is perpendicular to the surface of the substrate, a first rotating contact unit which contacts with the first fixed contact unit or the second fixed contact unit, and a second rotating contact unit which contacts with the second fixed contact unit or the first fixed contact unit. Both rotating contact units are respectively held by a rotating member which rotates on an axis along the reference line. A first facing contact leg is electrically connected to the first rotating contact unit and a second facing contact leg is electrically connected to the second rotating contact unit, wherein the two facing contact legs are disposed in such a manner as to face each other across the reference line. A central movable contact member is movable along the reference line into a state of electrical connection with the first and the second facing contact legs or a state of electrical disconnection from the first and the second contact legs. One or two operating shafts are provided for rotating the rotating member and moving the central movable contact member along the reference line. The above structure enables simultaneous switching operations on two independent circuits, and also enables the short-circuiting of two switching structures in the composite switch for a switching operation on one circuit.

6 Claims, 9 Drawing Sheets

COMPOSITE SWITCH

FIELD OF THE INVENTION

The present invention relates to a composite switch which performs simultaneous switching operation on a plurality of electrically independent circuits in various electronic apparatuses.

BACKGROUND OF THE INVENTION

In general, a conventional composite switch has the structure of FIG. 11 which shows a cross sectional front view of the same. As shown in FIG. 11, the composite switch comprises two switches 321 and 322, which respectively have identical specifications and are disposed coaxially in two stages.

When the composite switch is used, for instance, for adjusting the output level of two circuits which work according to respective signals in the audio apparatus of a stereo system, the switching operation is performed by rotating one operating shaft 303.

On the other hand, when the audio apparatus is used as one circuit of a monaural system by operating the apparatus with one signal, the common contact point 341 of the switch 321 and the common contact point 342 of the switch 322 are short-circuited by using another switch 305 as shown in FIG. 12 so that the composite switch enters into a state for a switching operation on one circuit.

However, the above conventional composite switch is large in size. Also when the switch is used for switching operation on one circuit, the additional switch 305 has to be used, which requires large space in the audio apparatus. Also the switches disposed at two different positions have to be respectively operated.

SUMMARY OF THE INVENTION

The object of the present invention is to address the conventional problems and aims to provide a composite switch which is small in size and performs simultaneous switching operations on two independent circuits, and which also has a function for short-circuiting two switching structures in the composite switch when the composite switch is used for switching a operation on one circuit.

For realizing the above object, the composite switch of the present invention comprises:

(a) a first fixed contact unit and a second fixed contact unit disposed on the surface of a substrate in such a manner as to be symmetrical about a reference line which is perpendicular to the surface of the substrate, (b) a first rotating contact unit which contacts with the first fixed contact unit or the second fixed contact unit, and a second rotating contact unit which contacts with the second fixed contact unit or the first fixed contact unit, wherein both the first and second rotating contact units are respectively held by a rotating member which rotates on an axis along the reference line, (c) a first facing contact leg electrically connected to the first rotating contact unit, and a second facing contact leg electrically connected to the second rotating contact unit, wherein the first and the second facing contact legs are disposed in such a manner as to face each other across the reference line, (d) a central movable contact member which is movable along the reference line into a state of electrical connection with the first and the second facing contact legs or into a state of electrical disconnection from the first and the second facing contact legs, and (e) one or two operating shafts for rotating the rotating member and moving the central movable contact member along the reference line.

The above structure enables a reduction in size of a composite switch which performs simultaneous switching operations on two independent circuits and has a function for short-circuiting two switching structures in the composite switch for a switching operation on one circuit.

DETAILED DESCRIPTION OF THE INVENTION

Hereinafter exemplary embodiments of the present invention are described with reference to the drawings.

First Exemplary Embodiment

Figure 1:
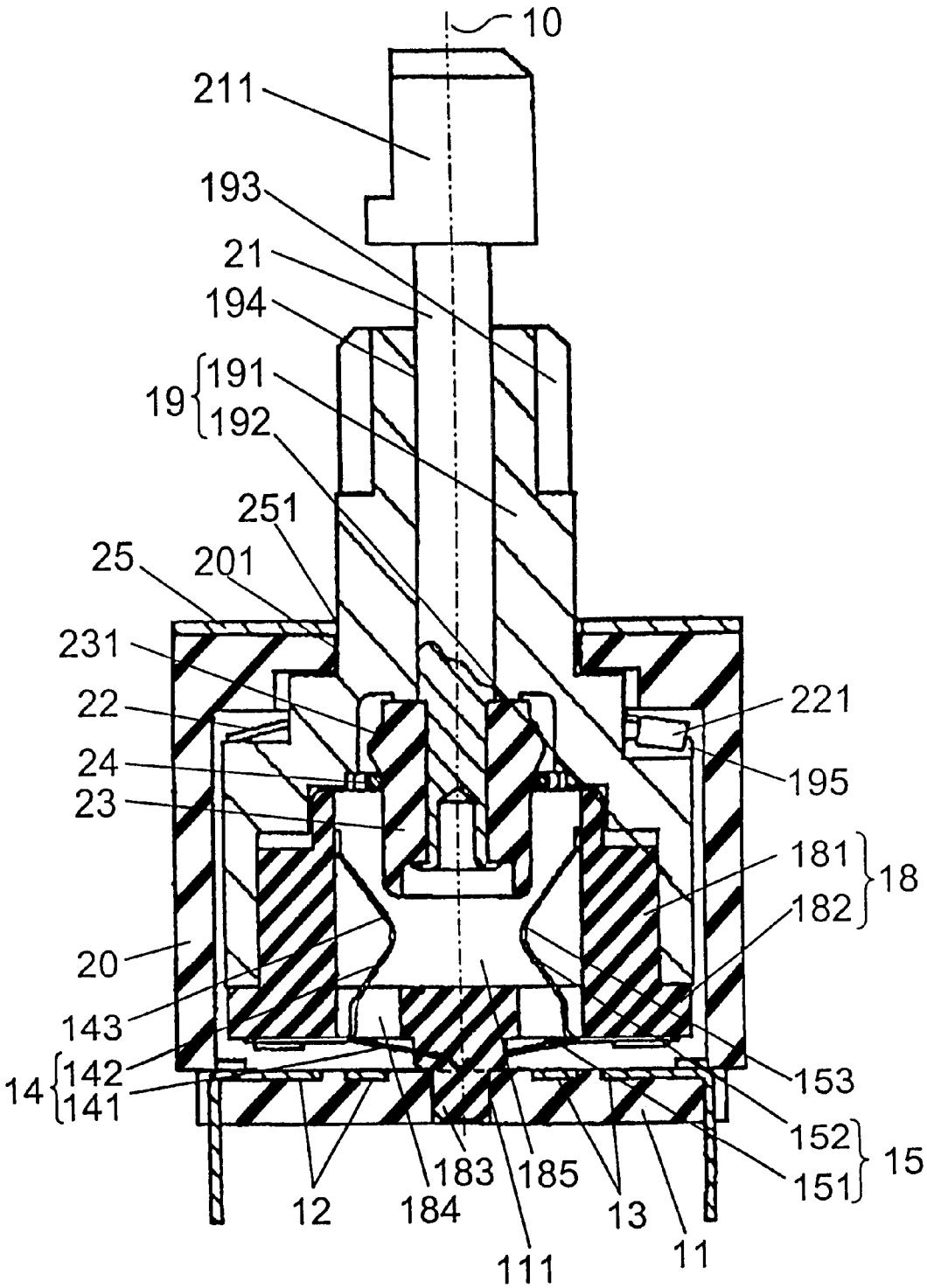
FIG. 1 is a cross sectional front view showing a composite switch in a first exemplary embodiment of the present invention.
Figure 2:
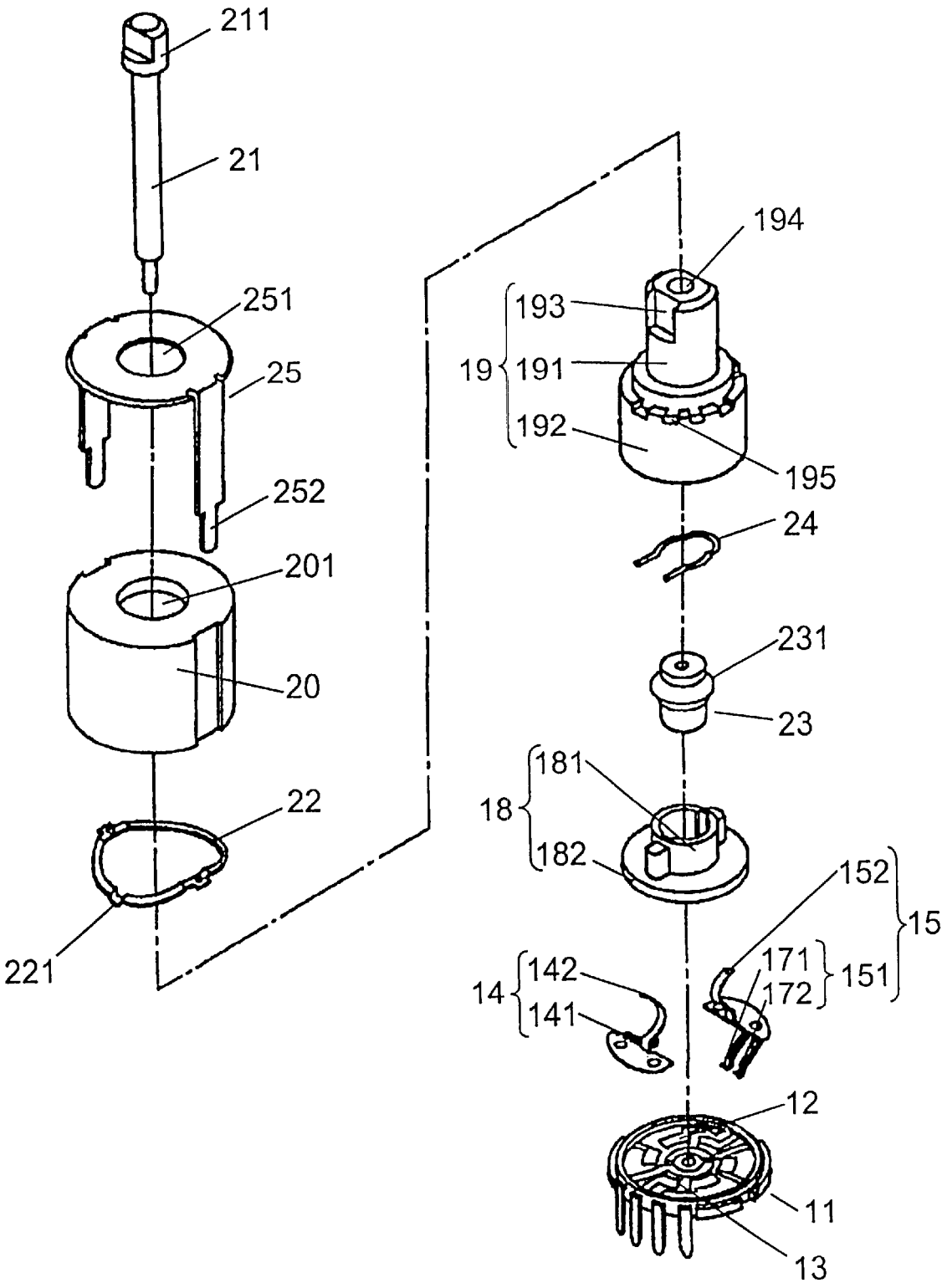
FIG. 2 is an exploded perspective view showing the composite switch in the same.
Figure 3:
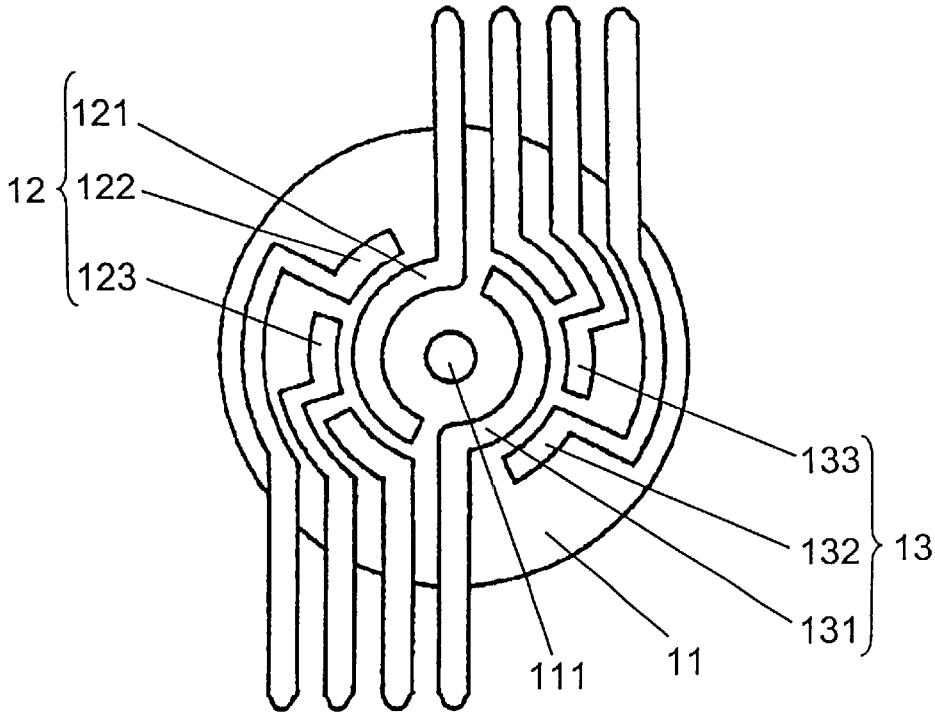
FIG. 3 is a plan view showing the structure of contact members on the substrate of the composite switch in the same.
Figure 4:
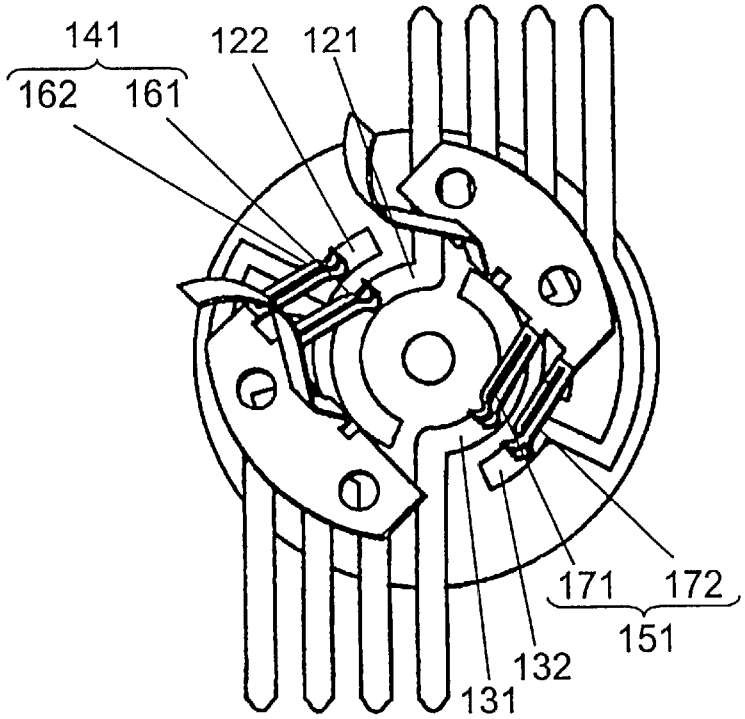
FIG. 4 is a schematic diagram showing the main portion of the contact structure of the composite switch in the same.
Figure 5:
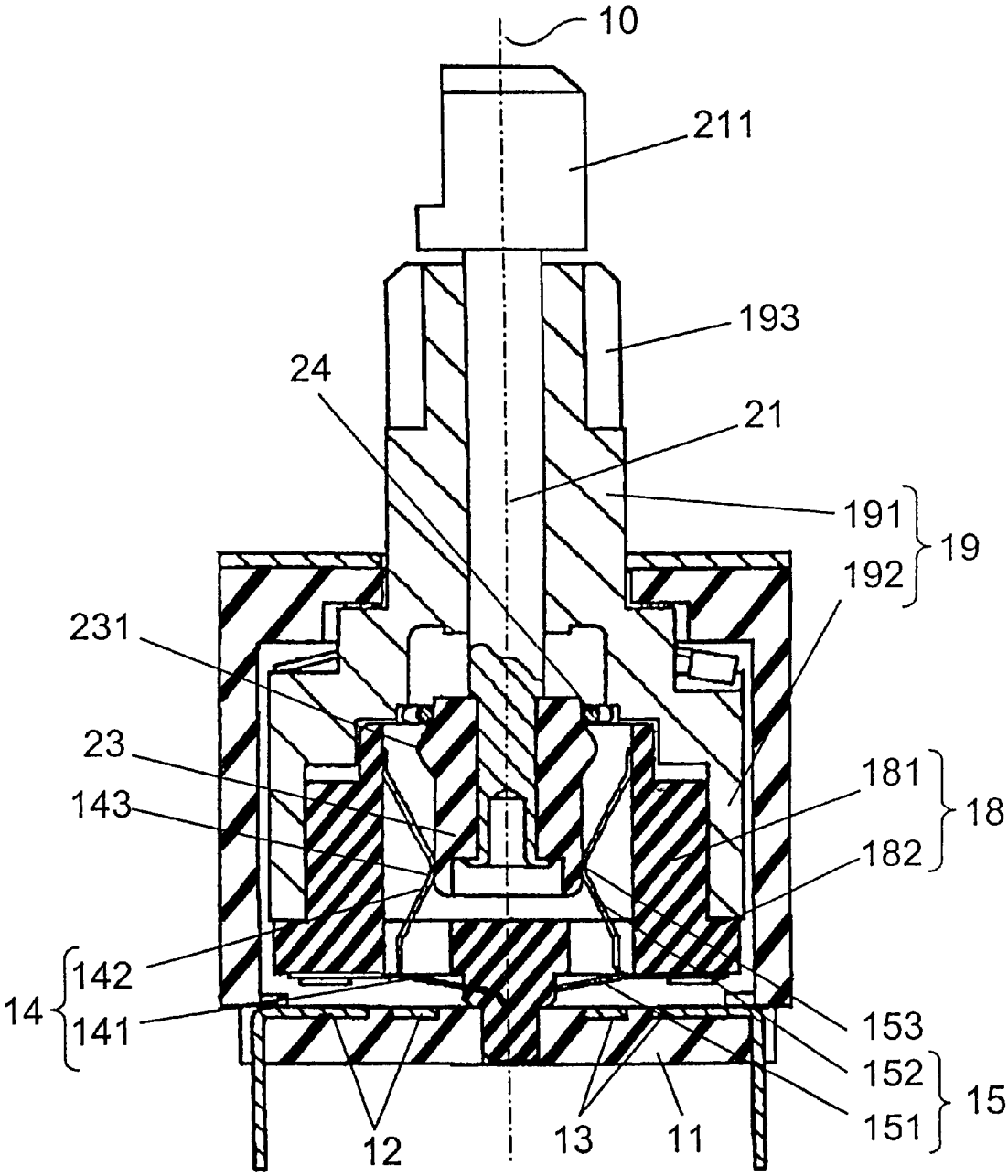
FIG. 5 is a cross sectional front view showing an inner operating shaft of the composite switch located at a pushed-position in the same.

FIG. 1 is a cross sectional front view showing a composite switch in a first exemplary embodiment of the present invention, FIG. 2 is an exploded perspective view showing the composite switch in the same, FIG. 3 is a plan view showing the structure of contact members on the substrate of the composite switch in the same, FIG. 4 is a schematic diagram showing the main portion of the contact structure of the composite switch in the same, and FIG. 5 is a cross sectional front view showing an inner operating shaft of the composite switch located at a pushed-position in the same.

In FIG. 1 and FIG. 2, on the upper surface of a substrate 11, a pair of fixed contact units (i.e. first and second fixed contact units) 12 and 13 are disposed symmetrically about a reference line 10 which is perpendicular to the surface of the substrate 11. The reference line 10 is located in such a manner as to pass through the center of the substrate, for instance. Also, as shown in FIG. 3, a center hole 111 is formed in the substrate 11 in such a manner that the center of the center hole 111 is located on the reference line 10.

As shown in FIG. 3, the fixed contact unit 12 comprises a semicircular (or circular arc of semicircle size) common contact member (i.e. a semicircular first common contact member) 121 disposed coaxially with the center hole 111 of the substrate 11, and individual contact members (i.e. first individual fixed contact members) 122 and 123 respectively disposed at the outer side of the common contact member 121 in such a manner as to be spatially isolated by a predetermined dimension from the common contact member 121 and to be concentric with the common contact member 121, also to respectively be located at radial positions at a predetermined angular pitch (i.e. as shown best in FIG. 3, the individual contact members 122, 123 are respectively located at different circumferential positions concentric with respect to the common contact member 121).

Also, in the same manner, the fixed contact unit 13 comprises a semicircular (or circular arc of semicircle size) common contact member (i.e. a semicircular second common contact member) 131 disposed coaxially with the center hole 111 of the substrate 11, and individual contact members (i.e. second individual fixed contact members) 132 and 133 respectively disposed at the outer side of the common contact member 131 in such a manner as to be spatially isolated by a predetermined dimension from the common contact member 131 and to be concentric with the common contact member 131, and also to respectively be located at radial positions at a predetermined angular pitch (i.e. as shown best in FIG. 3, the individual contact members 132, 133 are respectively located at different circumferential positions concentric with respect to the common contact member 131).

As shown in FIGS. 1, 2, 4 and 5, a movable contact unit 14 made of an elastic thin metal plate material has a unitary structure comprising a doglegged elastic facing contact leg (i.e. first facing contact leg) 142, and a rotating contact unit (i.e. a first rotating contact unit) 141 having a contact leg (i.e. a first contact leg) 161 which elastically contacts with the common contact member 121 or 131 and a contact leg (i.e. a second contact leg) 162 which elastically contacts with one of the individual contact members 122, 123, 132 or 133. The facing contact leg 142 and the rotating contact unit 141 are electrically connected since these are unitarily formed.

Also, a movable contact unit 15 made of an elastic thin metal plate material has a unitary structure comprising a doglegged elastic facing contact leg (i.e. a second facing contact leg) 152, and a rotating contact unit (i.e. a second rotating contact unit) 151 having a contact leg (i.e. a third contact leg) 171 which elastically contacts with the common contact member 131 or 121 and a contact leg (i.e. a fourth contact leg) 172 which elastically contacts with one of the individual contact members 132, 133, 122 or 123. The facing contact leg 152 and the rotating contact unit 151 are electrically connected since these are unitarily formed.

A rotating member 18 made of insulating resin comprises an upper cylindrical portion 181 and a lower flange portion 182. A round protrusion 183 formed at the center of the bottom of the flange portion 182 of the rotating member 18 engages with the center hole 111 of the substrate 11, and the cylindrical portion 181 of the rotating member 18 engages with a cavity of a lower large-diameter cylindrical portion 192 of a driving unit 19 in such a manner that the rotating member 18 rotates according to the rotation of the driving unit 19 on an axis along the reference line 10.

The movable contact units 14 and 15 are respectively fixed by caulking to the lower side of the flange portion 182 of the rotating member 18. The doglegged facing contact legs 142 and 152 respectively protrude into a cavity 185 of the cylindrical portion 181 through respective holes 184 formed through the flange portion 182. The doglegged portion 143 of the facing contact leg 142 and the doglegged portion 153 of the facing contact leg 152 face each other across the reference line 10 in such a manner as to respectively protrude toward the center of the cavity 185 (i.e., toward reference line 10).

An outer operating shaft 191 of the driving unit 19 is rotatably supported by a supporting hole 201 formed through the upper cover portion of a case 20. At the upper end portion of the outer operating shaft 191, which protrudes through the supporting hole 201, an operating portion 193 is formed, on which an operating knob (not illustrated) is disposed.

A joggle-like-protrusion 221 of an annular leaf spring 22 engages with one of plural joggle-like-cavities of a jagged portion 195 formed on the outer wall of the lower cylindrical portion 192 of the driving unit 19, whereby the rotating operation is steadily and moderately performed.

Through a center hole 194 formed through the outer operating shaft 191, an inner operating shaft 21 is disposed and held in such a manner as to be vertically movable (i.e., movable along the reference line 10) by a predetermined distance. At the upper end portion of the inner operating shaft 21, which protrudes upward through the center hole 194 of the outer operating shaft 191, an operating portion 211 is formed, on which an operating knob (not illustrated) is disposed. At the lower end of the inner operating shaft 21, which protrudes downward through the center hole 194 of the outer operating shaft 191, a central movable contact member 23 is fixed by caulking.

As shown in FIG. 1 and FIG. 2, the central movable contact member 23 has a swelled portion 231 of a predetermined diameter at the upper portion thereof. A U-shaped spring 24, which is held by the lower end of the outer operating shaft 191 of the driving unit 19, holds the central movable contact member 23 by elastically nipping the outer wall of the swelled portion 231.

In the state that the inner operating shaft 21 is pulled as shown in FIG. 1 (hereinafter the state shown in FIG. 1 is referred to as pulled-state or pulled-position of the operating shaft), the U-shaped spring 24 is located at the lower end of the swelled portion 231 of the central movable contact member 23. In this state, the central movable contact member 23 is not electrically connected with the facing contact legs (142, 152).

As shown in FIG. 1 and FIG. 2, a U-shaped uniting member 25 made of metal is placed in such a manner as to cover the case 20, the outer operating shaft 191 and the inner operating shaft 21 protrude through a hole 251 formed at the upper cover portion of the uniting member 25, and the lower leg portions 252 of the uniting member 25 are fixed to the lower side of the substrate 11 by caulking, whereby all of the components described in the above are united.

The operation of the composite switch of this exemplary embodiment having the above structure is described hereinafter.

First, the pulled-state of the inner operating shaft 21 is described. When the operating portion 193 of the outer operating shaft 191 is rotated in the state in which the inner operating shaft 21 is at the pulled-position as in FIG. 1, the rotating member 18 rotates, and the movable contact units 14 and 15 which are held by the lower side of the flange portion 182 of the rotating member 18 respectively slide on the fixed contact units 12 and 13 while elastically contacting with the fixed contact units (12, 13).

In more detail, as shown in FIG. 4, while elastically contacting the respective contact members, the contact leg 161 of the rotating contact unit 141 of the movable contact unit 14 slides on the common contact member 121, and the other contact leg 162 of the rotating contact unit 141 slides on one of the individual contact members 122 or 123. Also, while elastically contacting the respective contact members, the contact leg 171 of the rotating contact unit 151 of the movable contact unit 15 slides on the common contact member 131, and the other contact leg 172 of the rotating contact unit 151 slides on one of the individual contact members 132 or 133.

In this case, when the outer operating shaft 191 is rotated counterclockwise, for instance, the contact leg 162 contacts with the individual contact member 122 first and then contacts with the individual contact member 123, and the contact leg 172 contacts with the individual contact member 132 first and then contacts with the individual contact member 133, whereby electrical connection between the common contact member 121 and the individual contact member 122 or 123, and, electrical connection between the common contact member 131 and the individual contact member 132 or 133 are changed accordingly.

When the outer operating shaft 191 is further rotated counterclockwise, for instance, the contact leg 161 of the rotating contact unit 141 slides on the common contact member 131 and the other contact leg 162 of the rotating contact unit 141 slides on the individual contact members 132 or 133, and, the contact leg 171 of the rotating contact unit 151 slides on the common contact member 121 and the other contact leg 172 of the rotating contact unit 151 slides on the individual contact member 122 or 123, while the contact legs respectively elastically contact with these contact members.

In this case, as in the previous case, the contact leg 162 contacts with the individual contact member 132 first and then contacts with the individual contact member 133, and the contact leg 172 contacts with the individual contact member 122 first and then contacts with the individual contact member 123, whereby the electrical connection between the common contact member 131 and the individual contact member 132 or 133, and electrical connection between the common contact member 121 and the individual contact member 122 or 123 are changed accordingly.

The above change of the electrical connection is performed substantially simultaneously, and a signal based on the switching operation is sent out through terminals connected to the respective contact members.

As described above, the composite switch of this exemplary embodiment performs simultaneous switching operations on two independent circuits. In the above switching operation, the joggle-like-protrusion 221 of the annular leaf spring 22 engages with one of the joggle-like-cavities of the jagged portion 195 of the driving unit 19, whereby the switching operation is performed steadily and moderately.

Next, the operation in the pushed-state of the inner operating shaft 21 is described hereinafter. When the operating portion 211 of the inner operating shaft 21 is pushed downward, the inner operating shaft 21 and the central movable contact member 23 fixed to the lower end of the inner operating shaft 21 move downward, whereby the swelled portion 231 moves downward against the elastic nipping force of the U-shaped spring 24 which holds the lower end portion of the swelled portion 231 by nipping the same in the pulled-position of the inner operating shaft 21.

The central movable contact member 23 stops the downward movement thereof at the position where the U-shaped spring 24 reaches the upper end portion of the swelled portion 231 after passing over the largest-diameter portion of the swelled portion 231. The state that the movable contact unit 23 is pushed downward is shown in FIG. 5 (hereinafter the state of FIG. 5 is referred to as the pushed-state or pushed-position of the operating shaft). In the above operation, the U-shaped spring 24 provides for steady and moderate pushing operation.

In the pushed-state, as shown in FIG. 5, the lower end portion of the central movable contact member 23 made of metal enters into a state of electrical connection with the respective doglegged portions (143, 153) of the facing contact legs (142, 152) pressing these portions (143, 153) outward, whereby the two movable contact units 14 and 15 (i.e., the two common contact members 121 and 131) are electrically connected (i.e. short-circuited) with each other through the central movable contact member 23.

Then, when the operating portion 193 of the outer operating shaft 191 is rotated, the driving unit 19 rotates together with the rotating member 18, whereby the contact legs 161 and 162 of the movable contact unit 14 slide on the fixed contact unit 12 or 13 while elastically contacting with these, also the contact legs 171 and 172 of the movable contact unit 15 slide on the fixed contact unit 13 or 12 while elastically contacting with these, in the same manner as in the case of the pulled-state. However, in the pushed-state, since the common contact members 121 and 131 are short-circuited, a signal obtained by the switching operation of the composite switch on two independent circuits is equivalent with a signal which is obtained by the switching operation of the composite switch on one circuit.

After that, when the operating portion 211 of the inner operating shaft 21 is pulled, the central movable contact member 23 moves upward and the composite switch moves back to the state of FIG. 1 (i.e., the pulled-state). As a result, the central movable contact member 23 is disconnected from the facing contact legs (142, 152), and the composite switch moves back to the state for switching operations on two independent circuits. In the operation of pulling back the inner operating shaft 21 also, the U-shaped spring 24 operates to perform the operation steadily and moderately.

As described above, the above structure of the composite switch of this exemplary embodiment enables reduction of both the size and cost of the composite switch for performing simultaneous switching operation on two independent circuits, and for performing switching operation on one circuit by short-circuiting between the two common contact members in the composite switch.

Second Exemplary Embodiment

In the composite switch of this second exemplary embodiment, switching operation is performed by using one operating shaft, though two operating shafts are used in the first exemplary embodiment.

Figure 6:
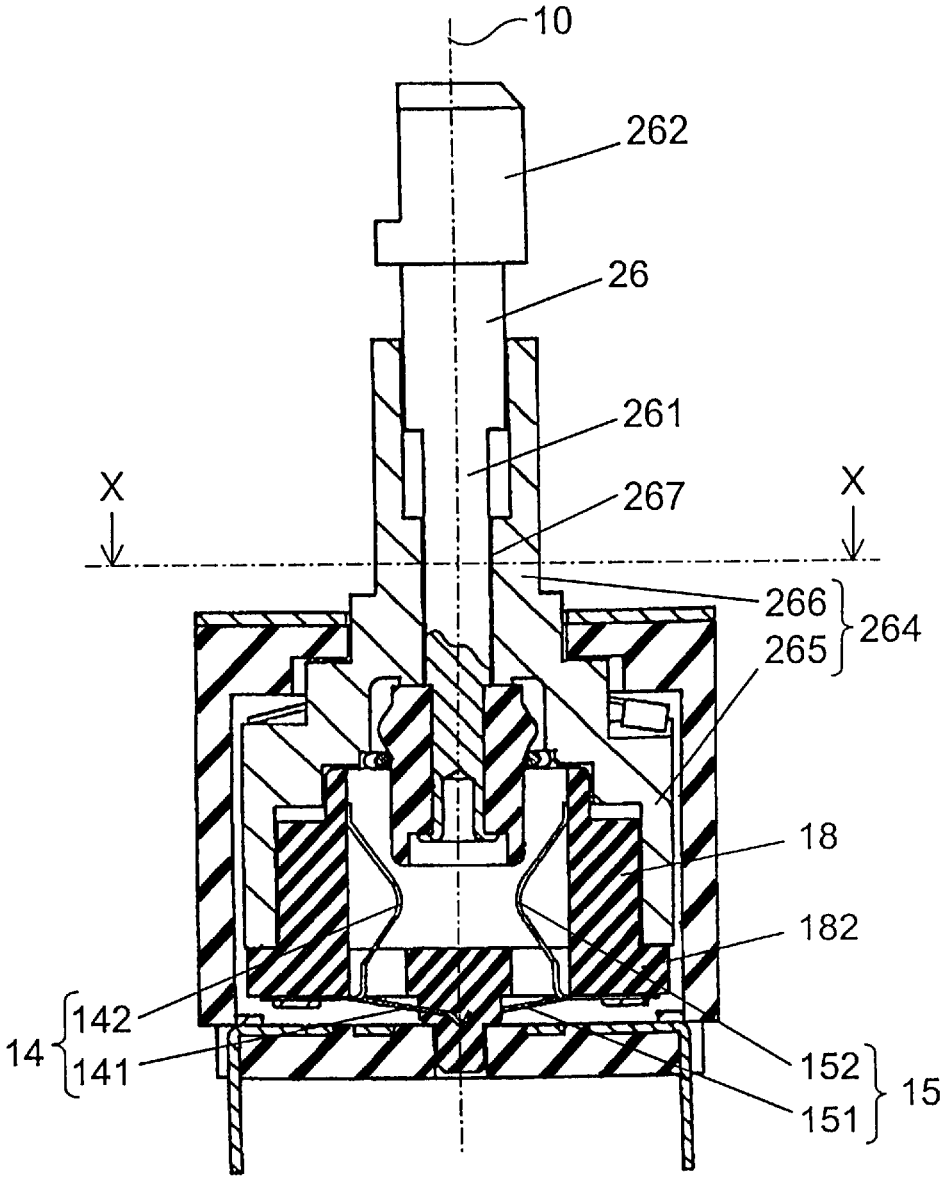
FIG. 6 is a cross sectional front view showing a composite switch in a second exemplary embodiment of the present invention.
Figure 7:
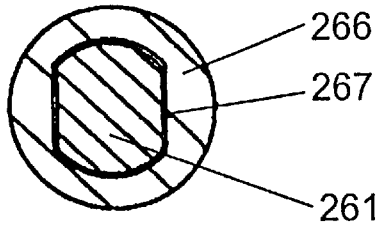
FIG. 7 is a cross sectional view taken along the line X—X of FIG. 6.

FIG. 6 is a cross sectional front view showing the composite switch in the second exemplary embodiment, and FIG. 7 shows a cross sectional view taken along the line X—X of FIG. 6.

First, the structure of a composite switch in the second exemplary embodiment is described hereinafter with reference to FIG. 6 and FIG. 7.

In FIG. 6 and 7, a driving unit comprises a lower large-diameter cylindrical portion 265 and an upper shaft portion 266, and the cross section of the lower portion 261 of an operating shaft 26 is formed to be of a non-round shape which is identical with the shape of hole 267 of the shaft portion 266 of the driving unit 264 but slightly smaller in cross-sectional dimensions than the dimensions of the hole 267 of the shaft portion 266 of the driving unit 264. With the above structure, the lower portion 261 of the operating shaft 26 engages with the hole 267 of the shaft portion 266 of the driving unit 264, and the operating shaft 26 and the driving unit 264 rotate together. Also the operating shaft 26 is held in such a manner as to be vertically movable by a predetermined distance independently from the driving unit 264.

The outer wall of the shaft portion 266 of the driving unit 264 is shaped with a round cross section and the diameter thereof is substantially identical with the diameter of an operating portion 262 formed at the upper end portion of the operating shaft 26. On the operating portion 262, an operating knob (not illustrated) is disposed.

Next, the operation of the composite switch of this exemplary embodiment having the above structure is described hereinafter.

When the operating knob (not illustrated) is rotated, the operating shaft 26 and the driving unit 264 rotate together, whereby a switching operation is performed, in the same manner as in the first exemplary embodiment, by the rotation of the rotating contact unit 141 of the movable contact unit 14 held by the lower side of the flange portion 182 of the rotating member 18, and by the rotation of the rotating contact unit 151 of the movable contact unit 15 also held by the lower side of the flange portion 182.

Also, by pushing the operating portion 262, the two facing contact legs (142, 152) are electrically connected (i.e., short-circuited) with each other, and by pulling the operating portion 262, the two facing contact legs (142, 152) are disconnected from each other, in the same manner as in the first exemplary embodiment.

The composite switch having the above structure is usable for switching operation on two circuits and for switching operation on one circuit.

As described above, in this exemplary embodiment, a composite switch which is smaller in size and superior in operational handiness can be realized.

Third Exemplary Embodiment

Figure 8:
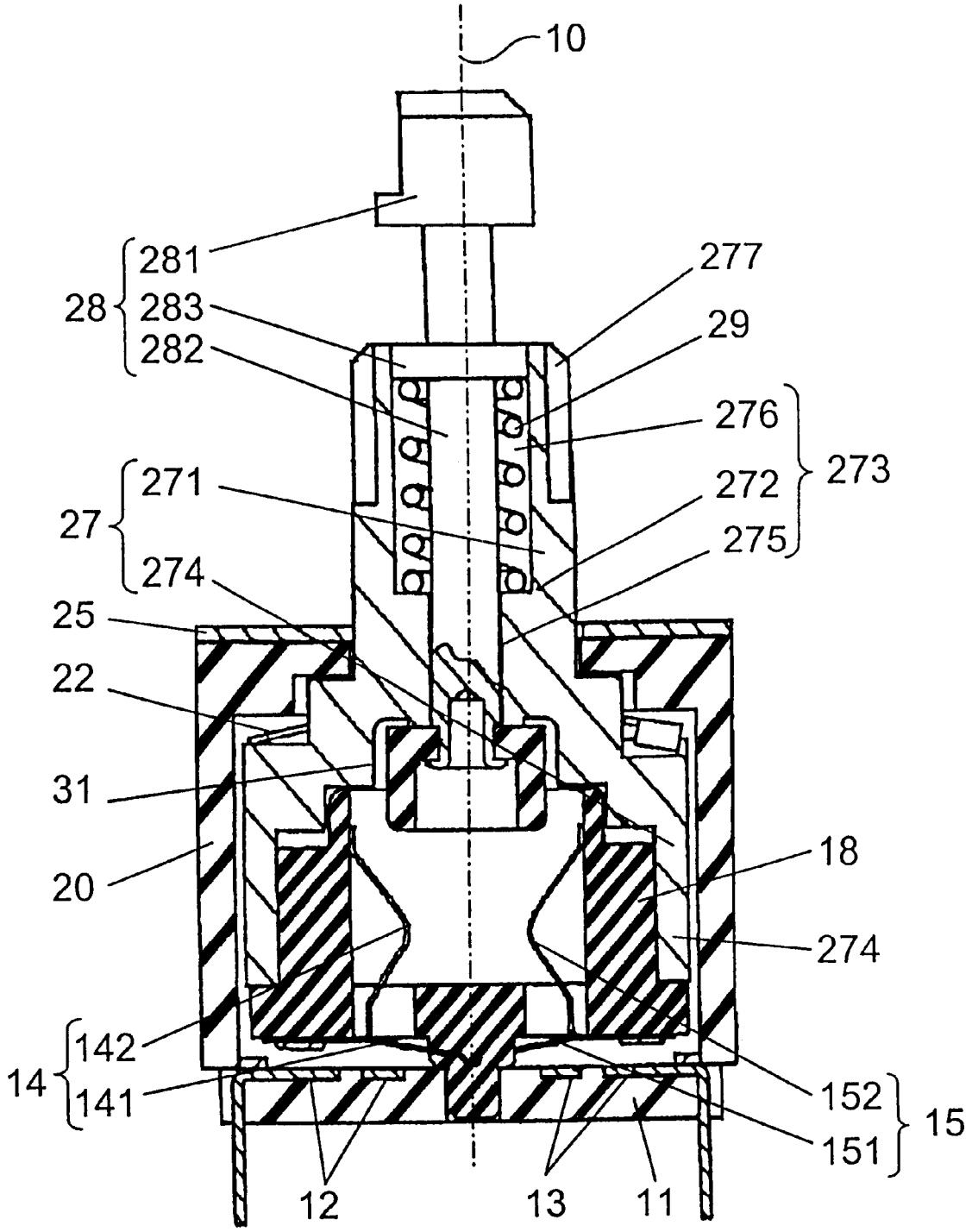
FIG. 8 is a cross sectional front view showing a composite switch in a third exemplary embodiment of the present invention.
Figure 9:
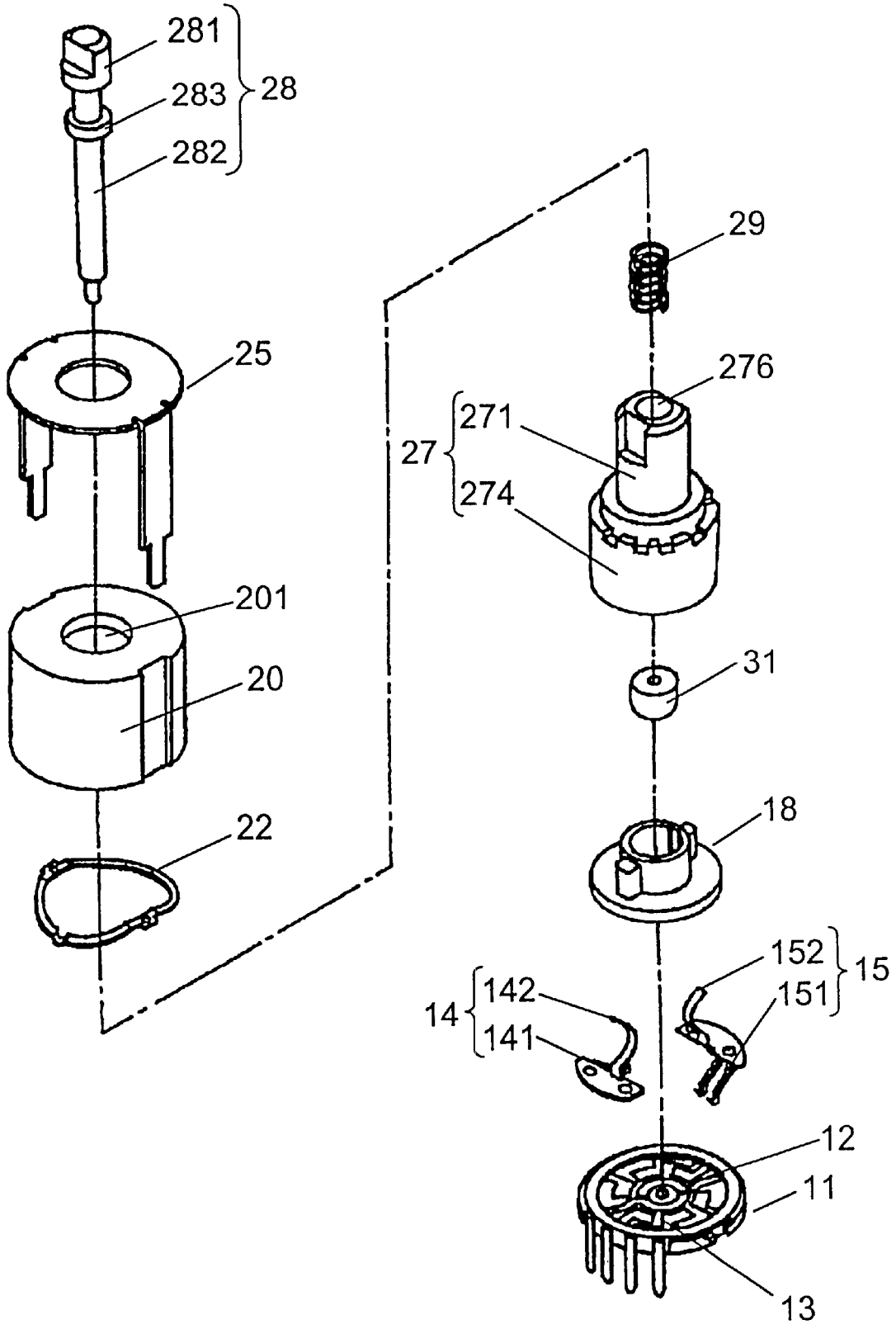
FIG. 9 is an exploded perspective view showing the composite switch in the same.
Figure 10:
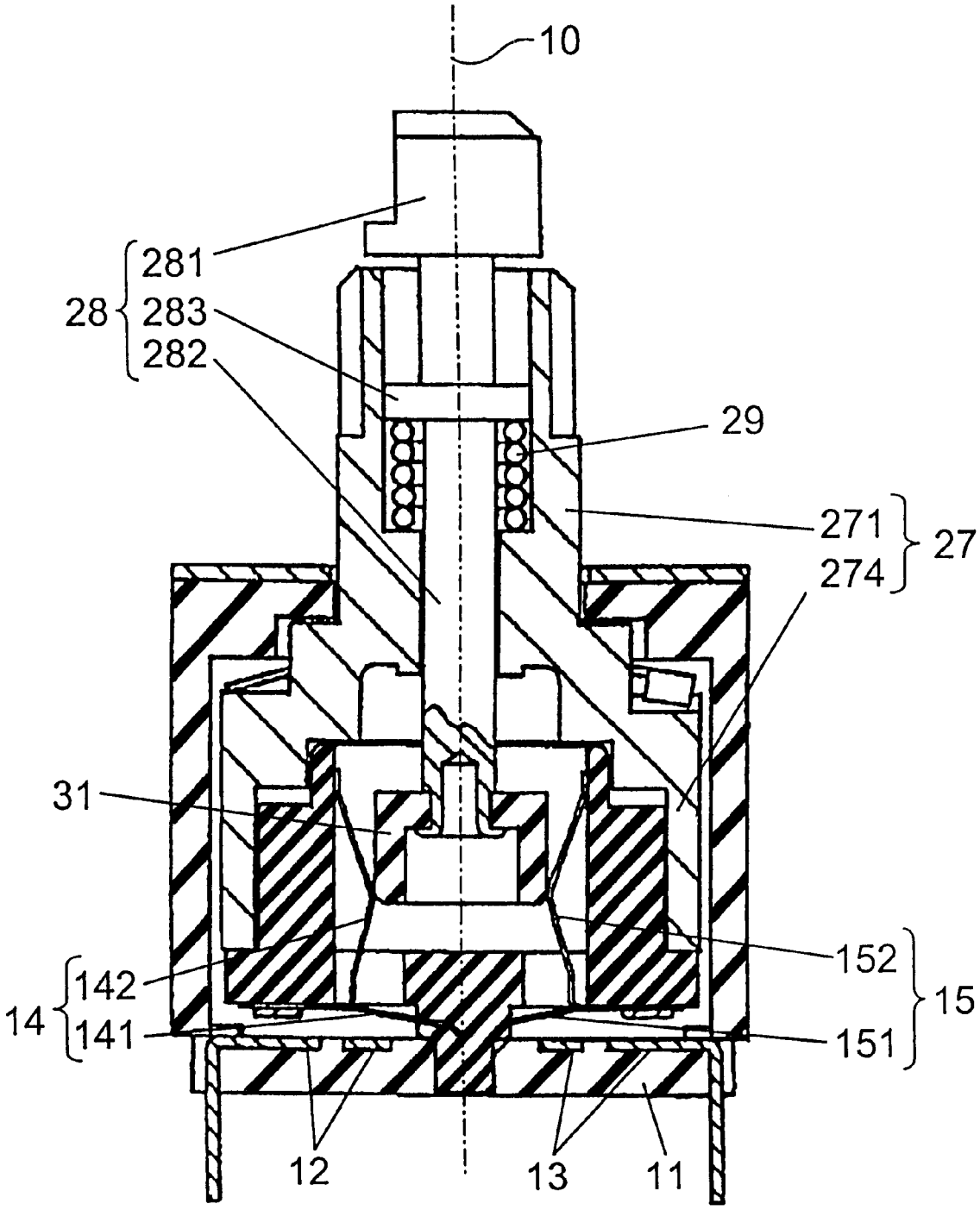
FIG. 10 is a cross sectional front view showing an inner operating shaft of the composite switch located at a pushed-position in the same.
Figure 11:
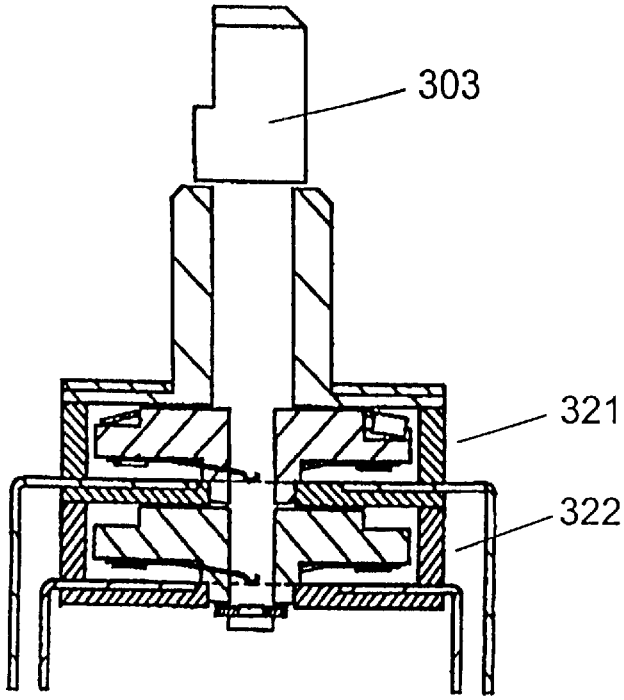
FIG. 11 PRIOR ART
FIG. 11 is a cross sectional front view showing a conventional composite switch.
Figure 12:
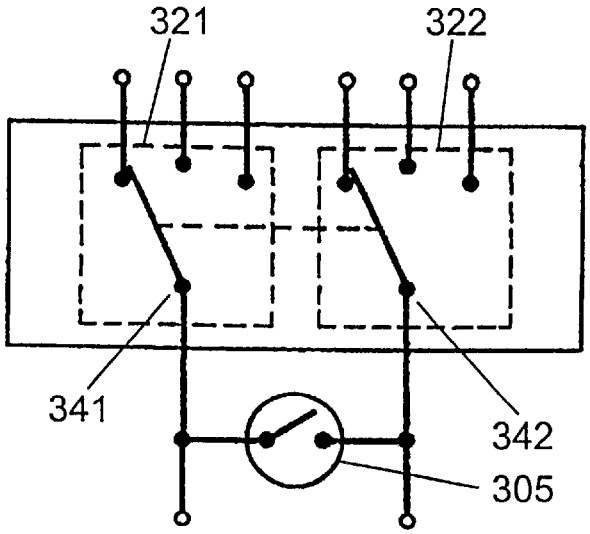
FIG. 12 PRIOR ART
FIG. 12 is a circuit diagram showing an example of operation in the same.

FIG. 8 is a cross sectional front view showing a composite switch in a third exemplary embodiment of the present invention, FIG. 9 is an exploded perspective view showing the composite switch in the same, and FIG. 10 is a cross sectional front view showing a state in which an inner operating shaft of the composite switch is located at a pushed-position in the same.

The structure of the composite switch of this exemplary embodiment is different from that of the composite switch of the first exemplary embodiment as follows. A center hole 273 is formed through an outer operating shaft 271 of a driving unit 27. The outer operating shaft 271 comprises a large-diameter hole portion 276, a small-diameter hole portion 275, and a step portion 272 formed at a boundary between the large-diameter hole portion 276 and the small-diameter hole portion 275. The inner operating shaft 28 comprises an upper large-diameter portion 283 and a lower round small-diameter portion 282. The inner operating shaft 28 is inserted into the center hole 273, and a helical spring 29 is disposed in the center hole 273 in such a manner as to extend from the step portion 272 to the lower end of the upper large-diameter portion 283 of the inner operating shaft 28. The helical spring 29 presses upward against the lower end of the upper large-diameter portion 283 of the inner operating shaft 28, whereby the inner operating shaft 28 is normally located at the pulled-position (refer to first exemplary embodiment). Also, the composite switch of this exemplary embodiment has a cylindrical central movable contact unit 31 having no swelled portion such as in the first exemplary embodiment.

The other structure is identical with that of the first exemplary embodiment.

Further details of this exemplary embodiment as described hereinafter with reference to FIG. 8, FIG. 9 and FIG. 10.

In this exemplary embodiment, as in the first exemplary embodiment, the movable contact unit 14 has the doglegged facing contact leg 142 and the rotating contact unit 141 which elastically contacts with the fixed contact unit 12 or 13 formed on the substrate 11, and the movable contact unit 15 has the doglegged facing contact leg 152 and the rotating contact unit 151 which elastically contacts with the fixed contact unit 13 or 12 formed on the substrate 11. The facing contact legs 142 and 152 face each other. The rotating member 18, which holds both movable contact units 14 and 15, is held by a lower cylindrical portion 274 of the driving unit 27. The outer operating shaft 271 of the driving unit 27 is rotatably supported by a supporting hole 201 of the case 20.

Also, the inner operating shaft 28 protrudes upward through the center hole 273 of the outer operating shaft 271, and has an operating portion 281 at the upper end portion thereof, on which an operation knob (not illustrated) is disposed.

However, in this exemplary embodiment, different from the first exemplary embodiment, the lower round small-diameter portion 282 of the inner operating shaft 28 engages with the hole of the small-diameter hole portion 275 of the outer operating shaft 271, the upper large-diameter portion 283 of the inner operating shaft 28 engages with the hole of the large-diameter hole portion 276 of the outer operating shaft 271, and the inner operating shaft 28 is pressed upward by the elastic force of the helical spring 29 inserted in the center hole 273. The spring 29 is disposed between the portion 283 and the step portion 272 of the center hole 273.

With the above structure, the inner operating shaft 28 is held to be vertically movable by a predetermined distance, and, in the state in which the inner operating shaft 28 is located at the pulled-position as shown in FIG. 8 by the elastic force of the helical spring 29, the cylindrical central movable contact member 31, which is fixed by caulking to the downward protruded end portion of the inner operating shaft 28, is electrically disconnected from the facing contact legs (142, 152).

Hereinafter, the operation of the composite switch of this exemplary embodiment having the above structure is described.

In the state in which the inner operating shaft 28 is at the pulled-position as shown in FIG. 8, the composite switch performs switching operations on two circuits in the rotating operation of the operating portion 277 of the outer operating shaft 271, in the same manner as in the first exemplary embodiment.

On the other hand, as shown in FIG. 10, when the operating portion 281 of the inner operating shaft 28 is pushed downward against the upward pressing force of the helical spring 29, the inner operating shaft 28 and the central movable contact member 31 move downward, whereby the lower end portion of the central movable contact member 31 enters into the state of electrical connection with the facing contact legs (142, 152), which results in electrical connection (i.e., short-circuit) between the two movable contact units 14 and 15 (i.e., the electrical connection between the two common contact members 121 and 131 of the respective fixed contact units 12 and 13). In the state of the short-circuit, the composite switch performs a switching operation on one circuit as described in the first exemplary embodiment.

After that, when the downward pushing force applied to the inner operating shaft is removed, the inner operating shaft 28 and the inner movable contact unit 31 are respectively moved back to the pulled-position as shown in FIG. 8 by the upward pressing force of the helical spring 29.

As described above, when the inner operating shaft is pushed downward, the composite switch of this exemplary embodiment performs a switching operation on one circuit. The function that the electrical connection changes when the operating shaft is pushed can be applied to a push switch as well.

The composite switch of this exemplary embodiment can also be formed in such a manner as to be operated with one operating shaft as in the case of the second exemplary embodiment.

As described in the above, in the present invention, a small and low cost composite switch, which has a function of simultaneous switching operations on two independent circuits and a function of short-circuiting two switching structures inside the composite switch for a switching operation on one circuit, is realized. Also, in the composite switch of the present invention, the operation can be performed steadily and moderately.

What is claimed is:

1. A composite switch comprising:

a substrate;

a first fixed contact unit and a second fixed contact unit disposed on a surface of said substrate in such a manner as to be symmetrical about a reference line which is perpendicular to the surface of said substrate;

a rotating member rotatable about an axis along said reference line;

a first rotating contact unit which contacts with one of said first fixed contact unit and said second fixed contact unit, and a second rotating contact unit which contacts with the other of said second fixed contact unit and said first fixed contact unit, wherein said first rotating contact unit and said second rotating contact unit are respectively held by said rotating member;

a first facing contact leg electrically connected to said first rotating contact unit and a second facing contact leg electrically connected to said second rotating contact unit, wherein said first facing contact leg and said second facing contact leg are disposed in such a manner as to face each other across said reference line;

a central movable contact member which is movable along said reference line between a state of electrical connection with said first facing contact leg and said second facing contact leg, and a state of electrical disconnection from said first facing contact leg and said second facing contact leg; and at least one operating shaft for rotating said rotating member and moving said central movable contact member along said reference line;

wherein said first fixed contact unit comprises a semicircular first common contact member and a plurality of first individual fixed contact members respectively located at different circumferential positions concentric with respect to said first common contact member;

wherein said second fixed contact unit comprises a semicircular second common contact member and a plurality of second individual fixed contact members respectively located at different circumferential positions concentric with respect to said second common contact member;

wherein said first rotating contact unit comprises a first contact leg and a second contact leg; and wherein said second rotating contact unit comprises a third contact leg and a fourth contact leg;

wherein, upon rotation of said rotating member, when said first contact leg contacts with said first common contact member and said third contact leg contacts with said second common contact member, said second contact leg alternately contacts with said first individual fixed contact members, and said fourth contact leg alternately contacts with said second individual fixed contact members, and when said first contact leg contacts with said second common contact member and said third contact leg contacts with said first common contact member, said second contact leg alternately contacts with said second individual fixed contact members, and said fourth contact leg alternately contacts with said first individual contact members.

2. The composite switch according to claim 1, wherein said first rotating contact unit and said first facing contact leg are unitarily formed of elastic thin metal plate material, and said second rotating contact unit and said second facing contact leg are unitarily formed of elastic thin metal plate material.

3. The composite switch according to claim 1, wherein said at least one operating shaft comprises a single operating shaft for rotating said rotating member and moving said central movable contact member along said reference line.

4. The composite switch according to claim 1, wherein said operating shaft and said central movable contact member are arranged so that movement of said central movable contact member along said reference line is stopped at one of a pulled-position and a pushed-position.

5. The composite switch according to claim 1, wherein said operating shaft is forced toward a pulled-position by elastic force of an elastic member.

6. The composite switch according to claim 1, wherein said at least one operating shaft comprises two operating shafts for rotating said rotating member and moving said central movable contact member along said reference line.

* * * * *